United States Patent [19]

Kamei et al.

[11] Patent Number: 4,503,358

[45] Date of Patent: Mar. 5, 1985

[54] FLUORESCENT LAMP HAVING SEPARATE COOLING MEANS FOR BALLAST AND FLUORESCENT TUBE

[75] Inventors: Taketo Kamei; Kimio Osada, both of Yokosuka, Japan

[73] Assignee: Tokyo Shibaura Denki Kabushiki Kaisha, Kawasaki, Japan

[21] Appl. No.: 384,053

[22] Filed: Jun. 1, 1982

[30] Foreign Application Priority Data

Jun. 5, 1981 [JP] Japan ..... 56-86479

[51] Int. Cl.[3] ..... H01J 17/28; H01J 17/34; H01J 61/52

[52] U.S. Cl. ..... 315/58; 315/62; 313/22; 313/493

[58] Field of Search ..... 313/17, 22, 35, 46, 313/493; 315/53, 57, 62, 58, 112

[56] References Cited

U.S. PATENT DOCUMENTS

| | | | |
|---|---|---|---|
| 3,551,736 | 12/1970 | Doehner | 315/100 |
| 3,611,009 | 10/1971 | McNeil | 315/62 X |
| 4,199,708 | 4/1980 | Lauwerijssen et al. | 313/493 |
| 4,270,071 | 5/1981 | Morton | 315/53 |
| 4,272,703 | 6/1981 | Eckberg | 315/205 |
| 4,300,073 | 10/1981 | Skwirut et al. | 315/53 |
| 4,375,607 | 3/1981 | Morton et al. | 315/53 X |
| 4,389,595 | 6/1981 | Kamei et al. | 315/57 |

FOREIGN PATENT DOCUMENTS 55-59648 6/1980 Japan .

OTHER PUBLICATIONS

European Search Report, EP 82104891.5.

*Primary Examiner*—Palmer Demeo
*Assistant Examiner*—Sandra L. O'Shea
*Attorney, Agent, or Firm*—Cushman, Darby & Cushman

[57] ABSTRACT

A fluorescent lamp device according to the present invention includes a ballast, a screw base electrically connected to the ballast, a fluorescent tube curved in an arc at three portions thereof, a bowl-shaped member for housing the ballast with the screw base fixed projecting outside therefrom, a globe, and a partition plate attached to an open end of the member so as to thermally isolate or insulate the ballast from the fluorescent tube and to which the fluorescent tube is fixed. The bowl-shaped member is provided with a plurality of ventilating slits for discharging heat radiated from the ballast, and also with air-ducts for communicating the space inside the globe with the outside air. The globe is also provided with holes at the top portion thereof.

7 Claims, 6 Drawing Figures

FLUORESCENT LAMP HAVING SEPARATE COOLING MEANS FOR BALLAST AND FLUORESCENT TUBE

BACKGROUND OF THE INVENTION

The present invention relates to a fluorescent lamp device and, more particularly, a fluorescent lamp device capable of being freely detachably connected to the external socket for an incandescent lamp and used instead of incandescent lamp.

The fluorescent lamp which can be replaced instead of incandescent lamp has become popular these days. The fluorescent lamp of this type has a screw base which can be fitted into the incandescent lamp socket, and when the screw base is connected to the socket, the fluorescent lamp can be used in same manner as the incandescent lamp.

In the conventional fluorescent lamp, a reactance ballast, starter circuit and the like are compactly housed together with a fluorescent tube, in a same space of an envelope which includes a bowl-shaped member and globe. When the fluorescent lamp is kept turned on, temperature in the globe rises undesirably due to heat generated from the ballast and the fluorescent tube, particularly heat radiated from the ballast. It is usually desirable that the fluorescent lamp is designed to achieve maximum fluorescent efficiency when temperature around the lamp is from 20° C. to 25° C. and tube wall temperature is about 40° C. However, temperature in the envelope rises even up to 100° C. because of heat mentioned above. As a result, the intensity of ultraviolet rays of the fluorescent tube and the intensity of visible rays radiated from fluorescent material coated on the inner surface of the tube are remarkably reduced to thereby lower the luminous efficacy of fluorescent lamp.

The bowl shaped member and/or globe in the conventional fluorescent lamp are provided with a plurality of ventilating bores so as to eliminate the above-mentioned drawback. Air outside the lamp comes into the lamp through these ventilating bores and air of high temperature in the lamp flows outside the lamp through these ventilating bores. Temperature rise in the fluorescent tube kept lightening is thus improved a little. However, heat which is radiated from the reactance ballast and which corresponds to most of heat generated can not be expelled enough. In addition, fresh outside air entering into the globe through the ventilating bores is also heated by the reactance ballast. Therefore, temperature in the envelope can not be kept to the above-mentioned one optimum for the fluorescent tube. Particularly when the fluorescent lamp is used the screw base side down, heat radiated from the reactance ballast rises to hit the fluorescent tube directly. Therefore, heat discharge is not enough in the conventional fluorescent lamp and temperature in the lamp can not be lowered to the above-mentioned optimum one (or target one). It can not be expected therefore that the luminous efficacy of fluorescent lamp is enhanced satisfactorily.

SUMMARY OF THE INVENTION

An object of the present invention is to provide a new and improved fluorescent lamp device capable of effectively preventing the rise of ambient temperature of fluorescent tube housed in the lamp so as to improve its luminous efficacy.

A fluorescent lamp device according to the present invention has a fluorescent tube housed in an envelope and electrically connected to a ballast and is fitted into an external socket when used. The fluorescent tube is bent at at least one position thereof to a predetermined form. The ballast is thermally insulated from the fluorescent tube in the envelope. The fluorescent tube is contacted at least partially and directly with air outside independently of the ballast. Thus, heat exchange between the fluorescent tube and the outside air is promoted.

DETAILED DESCRIPTION OF THE PREFERRED EMBODIMENT

Figure 1:
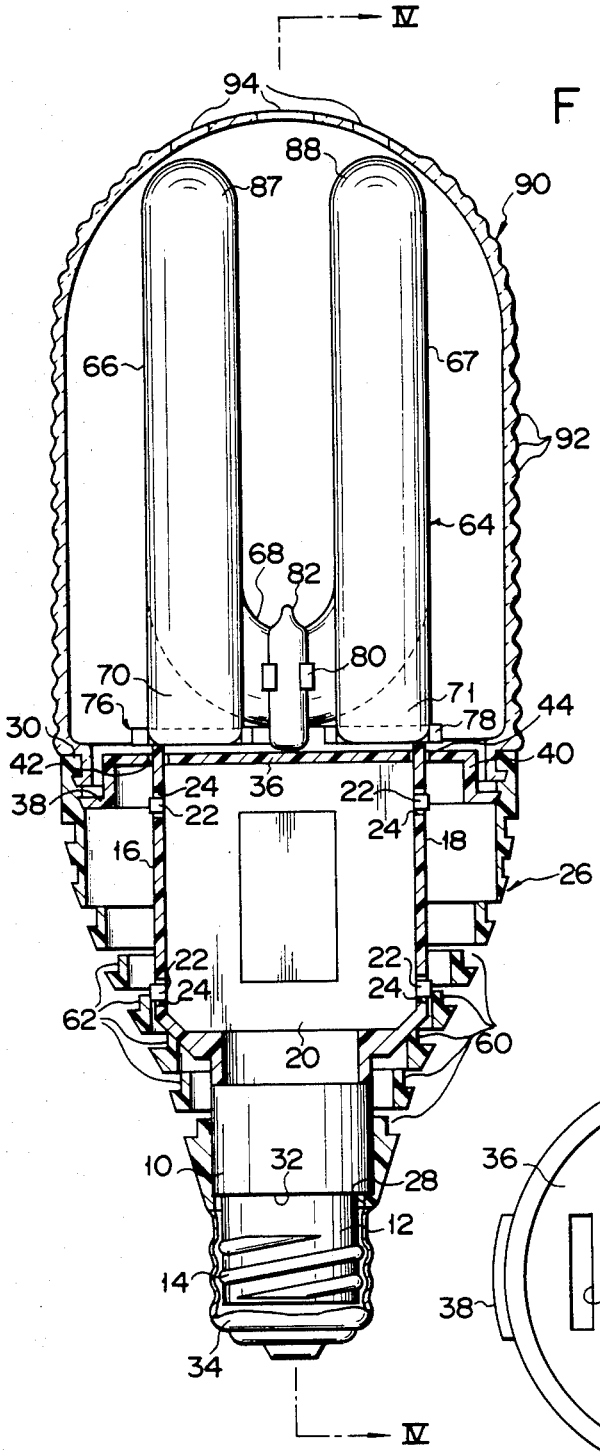
FIG. 1 is a cross sectional view showing an embodiment of fluorescent lamp according to the present invention and having a screw base.

Referring now to FIG. 1, there is illustrated a cross sectional view of one embodiment of fluorescent lamp according to the present invention. A cylinder-shaped chassis 10 is made of heat resistant and electrically insulating resin material and has a male screw portion 12 at one end thereof. The male screw portion 12 is formed substantially cylindrical and has a radius smaller than that of chassis 10. The male screw (e.g. E-26 type) 14 is formed on an outer surface of the male screw portion 12. A pair of support arm members 16 and 18 are arranged opposite to each other and attached integral to the chassis 10 at the other end thereof. The support arm members 16 and 18 extend in the axial direction of the chassis 10 and serve to fixedly sandwich a reactance ballast 20 therebetween. Namely, the ballast 20 has on its opposite sides engaging tongues 22, which are bent to engage with recesses 24 of paired support arm members 16 and 18, respectively, thus causing the ballast 20 to be immovably fixed between the support arm members 16 and 18.

The above-mentioned structure fixing the ballast 20 are housed in a bowl-shaped member 26, which is made of heat resistant and electrically insulating resin material. An open end 28 of the bowl-shaped member 26 has an inner diameter corresponding to the outer diameter of the chassis 10 and a flange projecting inward and radially. Another open end 30 of the bowl-shaped member 26 has an inner diameter larger than at least the outer shape of ballast 20. Therefore, the structure in which the ballast 20 is fixed is fitted into the bowl-shaped member 26 through the open end 30 and foused therein with its male screw portion 12 positioned forward. When the structure is housed like this, a stepped portion 32 on the chassis 10 is held by the open end 28 of bowl-shaped member 26. When under this condition, a screw base 34 made of metal is screwed into the male screw portion 12, thus allowing the chassis 10 to be connected, immovable in the axial direction, to the open end 28 of the bowl-shaped member 26.

Figure 2:
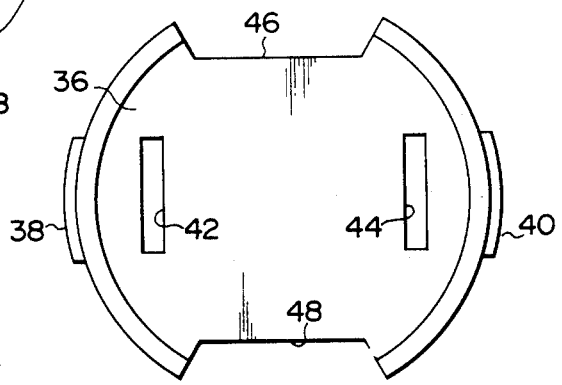
FIG. 2 is a plane view showing a partition plate arranged in the fluorescent lamp shown in FIG. 1.

A partition plate 36 shown in FIG. 2 is attached to the open end 28 of the bowl-shaped member 26 by means of a pair of its hooks 38 and 40. The partition plate 36 is made of thermally insulating material. The paired support arm members 16 and 18 are fitted this time into slots 42 and 44 of partition plate 36. When under this condition, the ballast 20 and chassis 10 are stably housed in the bowl-shaped member 26.

Figure 3:
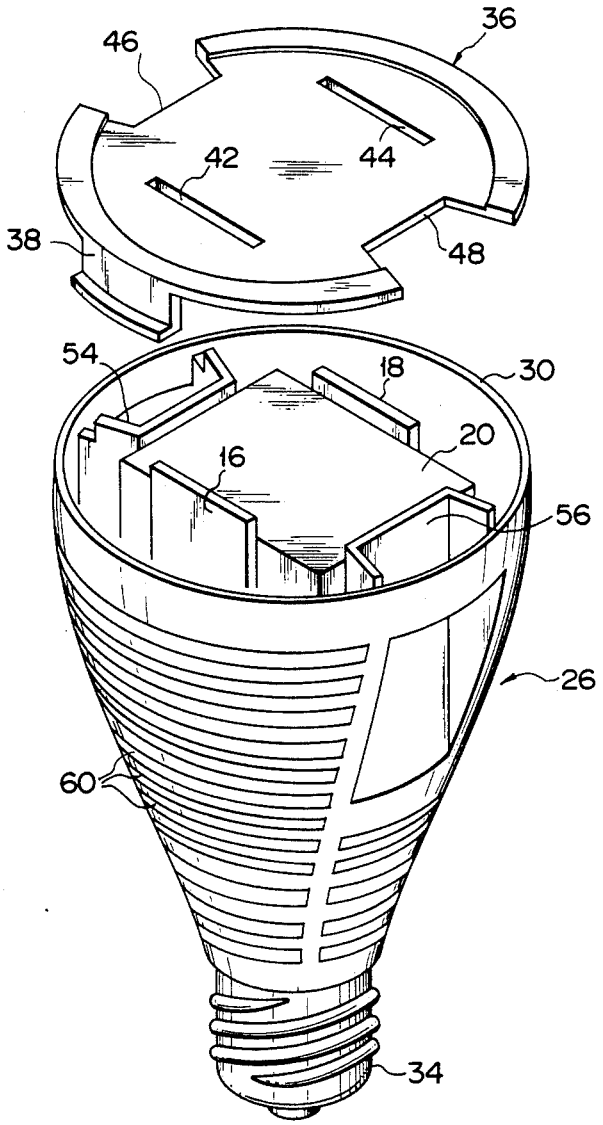
FIG. 3 is a perspective view showing a bowl-shaped member and the partition plate of FIG. 2, said bowl-shaped member housing a ballast for the fluorescent lamp shown in FIG. 2.

As shown in FIG. 2, a pair of recesses 46 and 48 are provided in the partition plate 36 at opposite sides thereof. Recesses 46 and 48 are recessed perpendicular to hooks 38 and 40. The distance between recesses 46 and 48 of the partition plate 36 is determined depending upon the outer shape of the ballast 20. FIG. 3 schematically shows the relative positional relation between the partition plate 36 and the bowl-shaped member 26 when they are assembled. As shown in FIG. 3, grooves 54 and 56 are provided in the bowl-shaped member 26 at opposite sides thereof. The profile of each of grooves 54 and 56 on the side of open end 30 of the bowl-shaped member 26 corresponds to each of paired recesses 46 and 48 in the partition plate 36. Axially extending plate portions 58 and 59 (FIG. 4) of the grooves 54 and 56 are tightly contact with the outer surface of the ballast 20 to support the ballast 20. When the partition plate 36 is attached to the bowl-shaped member 26, upper ends of the grooves 54 and 56 of the member 26 closely fitted into the recesses 46 and 48 of the partition plate 36, respectively. The support arm portions 16 and 18 are also fitted this time into slots 42 and 44 in the partition plate 36. Therefore, a chamber in which the ballast 20 is accommodated is constituted by the paired support arm members 16 and 18, the plate portions 58 and 59 of the grooves 54 and 56 and the partition plate 36.

A plurality of ventilating slits 60 are arranged extending in the circumferential direction of the bowl-shaped member 26, as shown in FIG. 3. Namely, the ventilating slits 60 extend entirely along the circumference of the bowl-shaped member 26 at this portion thereof which is adjacent to the screw base 34, but partially along the circumference thereof at that portion at which the grooves 54 and 56 extend in the axial direction. The reactance ballast 20 housed in the bowl-shaped member 26 contacts directly with the outside air through the ventilating slits 60.

Referring again back to FIG. 1, there is shown the cross section of each of the ventilating slits 60 in the circumference of the bowl-shaped member 26. Namely, a ring-shaped wall 62 is erected from the bowl-shaped member 26 in the axial direction in each of the ventilating slits 60 and has a height smaller than or equal to the width of each of the ventilating slits 60, in this embodiment. Even when the fluorescent lamp is viewed from the side thereof, therefore, the ballast 20 and other components such as wiring (not shown) housed in the bowl-shaped member 26 are hardly left invisible. In addition, these walls 62 serve to prevent dust from easily entering into the bowl-shaped member 26 but without lowering its heat discharging effect.

Figure 4:
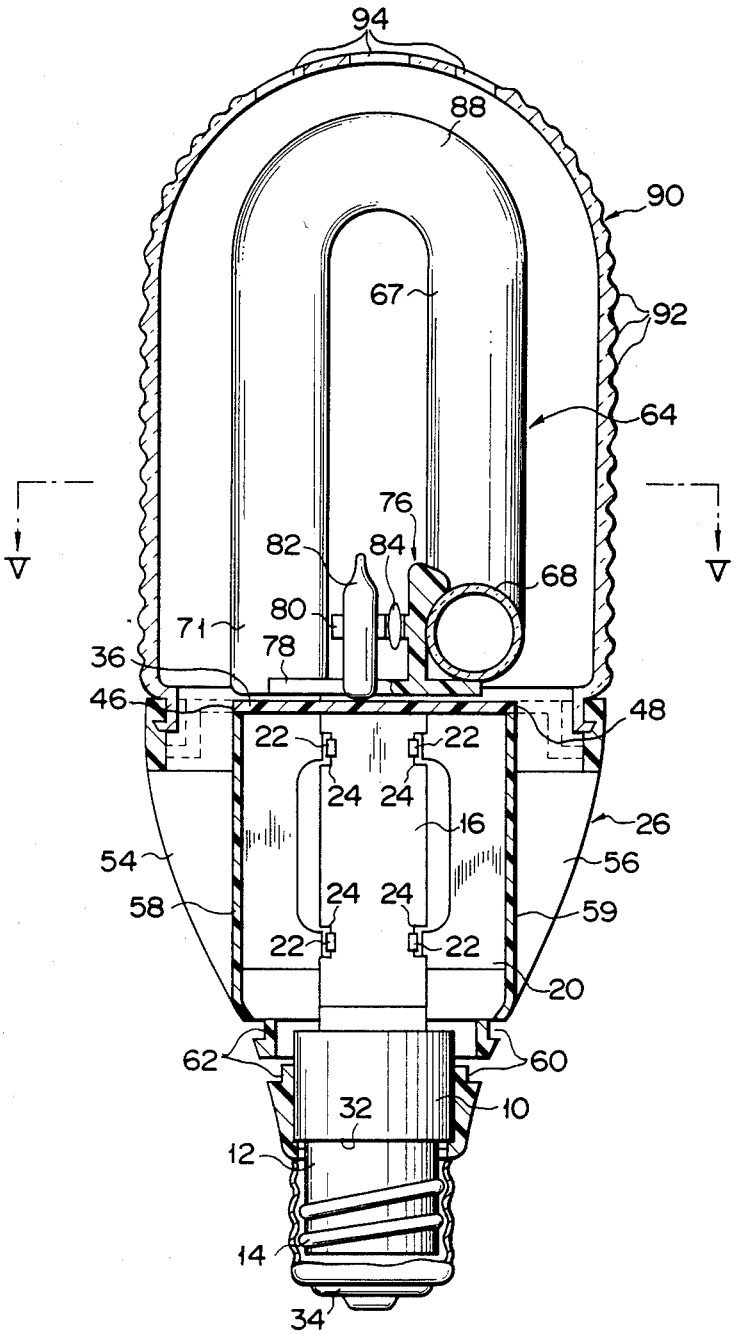
FIG. 4 is a cross sectional view of the fluorescent lamp taken along a line IV—IV in FIG. 1.

FIG. 4 is a cross sectional view taken along a line IV—IV in FIG. 1. The embodiment of fluorescent lamp according to the present invention will be further described referring to FIG. 4. A fluorescent tube 64 is attached to the partition plate 36, which is attached to the bowl-shaped member 26 in which the ballast 20 is housed with the screw base 34 fixed projecting in the axial direction. The fluorescent tube 64 is bent at at least one position thereof so as to be compactly housed in a predetermined closed space. In the case of this embodiment, the fluorescent tube 64 is curved arc at three positions thereof, so that it has a U-shaped curved tube portion 68 at which one ends of reverse U-shaped tube portions 66 and 67 parallel to each other are connected integral and continuous to each other (the shape of fluorescent tube is shown in detail in FIG. 3 of U.S. patent application No. 190,252). Electrodes (not shown) are provided at the other ends 70 and 71 of reverse U-shaped tube portions 66 and 67, respectively.

The end electrode portions 70 and 71 adjacent to each other and the lower curved tube portion 68 of the fluorescent tube 64 are fixed adjacent to one another on the partition plate 36 by means of an attaching member 76, which includes holders 78 for holding the end electrode portions 70 and 71 of the fluorescent tube 64. The attaching member 76 further includes a parts support 80 formed integral to the holder for holding the one end electrode portion 70 of the fluorescent tube 64, said parts support 80 serving to support a glow lamp 82, a capacitor 84 and the like and also resiliently support the lower U-shaped tube portion 68. The opposite end of the parts support 80 is formed like a hook to stably hold the lower curved tube portion 68 of the fluorescent tube 64. In other words, the fluorescent tube 64 is supported at three points thereof by the attaching member 76 and stably fixed together with the glow lamp 82 and capacitor 84 on the partition plate 36. Under this condition, the end electrode portions 70 and 71 and the lower curved tube portion 68 of the fluorescent tube 64 are located adjacent to the pair of recesses 46 and 48 of the partition plate into which grooves 54 and 56 of bowl-shaped member 26 are closely fitted. Therefore, cooling efficiency at the portions 70, 71 and 68 of fluorescent tube 64 is substantially enhanced because these portions 70, 71 and 68 are contacted directly with air outside through the grooves 54 and 56. In addition, the fluorescent tube 64 is separated from the ballast 20 in the bowl-shaped member 26 by the partition plate 36. Reference numerals 87 and 88 denote upper tops of the reverse U-shaped curved tube portions 66 and 67.

A globe 90 made of known light-transmitting material is fixed to the open end 30 of the bowl-shaped member 26 constructed as above. A plurality of ring-shaped prism bodies 92 are formed on the outer circumference of the globe 90, extending parallel to one another in the circumferential direction thereof, for example. Light emitted from the fluorescent tube 64 is diffused or scattered by the prism bodies 92 and transmitted outside. Plural holes 94 are formed at the top portion of the globe 90 so as to permit the inner space of the globe 90 to be exposed to the outside. In the case of this embodiment, one hole is located at the center top of the globe 90 and other ones are selected to be nearest to the tops 87 and 88 of the reverse U-shaped tube portions 66 and 67 of the fluorescent tube 64, whereby the upper tops 87 and 88 of the fluorescent tube 64 enclosed by the globe 90 are contacted directly with the outside air through these holes 94.

Figure 5:
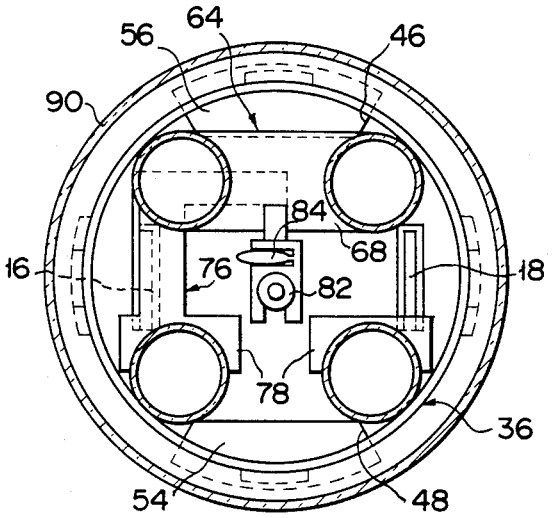
FIG. 5 is a cross sectional view of the fluorescent lamp taken along a line V—V in FIG. 4.

FIG. 5 is a cross sectional view taken along a line V—V in FIG. 4. The glow lamp 82 and capacitor 84 are fixed substantially in the center area on the partition plate 36 to which the fluorescent tube 64 is stably fixed. As more apparent from FIG. 5, the open end of the groove 54 is located adjacent to two end electrode portions 70 and 71 of the fluorescent tube 64 while the one of the other groove 56 adjacent to the lower curved tube portion 68 thereof.

Figure 6:
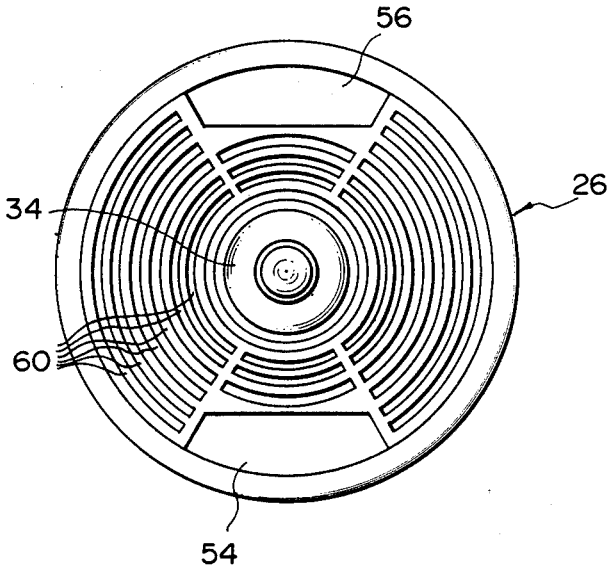
FIG. 6 shows the fluorescent lamp viewed from its bottom.

FIG. 6 shows the above-described fluorescent lamp viewed from the underside thereof and the relative positional relation between ventilating slits 60 formed around the bowl-shaped member 26 becomes more apparent from FIG. 6.

In the fluorescent lamp having such arrangement as described above according to one embodiment of this invention, the reactance ballast 20 is housed in the bowl-shaped member 26 in such a way that it is thermally isolated or insulated from the curved fluorescent tube 64 by the partition plate 36 made of heat resistant material. The ballast 20 contacts independently with the outside air through the ventilating slits 60 formed in the side of the bowl-shaped member 26. When the lamp is kept turned on, therefore, heat radiated from the ballast 20 is not discharge outside through the fluorescent tube 64 but directly outside. Namely, the ballast 20 can be heat-exchanged with air outside through the ventilating slits 60 and independently of the fluorescent tube 64.

The bowl-shaped member 26 is further provided with the grooves 54 and 56 which serve as air-ducts for communicating the inner space of the globe 90, in which the fluorescent tube 64 is housed, directly with the outside air. In addition, the holes 94 are provided at the top portion of the globe 90. Therefore, the outside air flows into the inner space of the globe 90, in which the fluorescent tube 64 is housed, through the grooves 54 and 56 and/or the holes 94, thus enabling the ventilation in the globe 90 to be enhanced. In other words, heat exchange between the fluorescent tube 64 in the globe 90 and the outside air is achieved through the grooves 54, 56 and/or the holes 94 in the globe 90 independently of that of the ballast 20, thus leaving heat exchange between the fluorescent tube 64 and the outside air uninfluenced by heat radiated from the ballast 20. The open ends of the grooves 54 and 56, which serve as air-ducts and which are placed to introduce the fresh air from the outside to the inner space of the globe 90, are located adjacent to the two end electrode portions 70 and 71 of the fluorescent tube 64. Therefore, the capacity of air entering into the globe 90 through the grooves 54 and 56 and the cooling end portions 70 and 71 of the fluorescent tube 64 is so increased as to effectively prevent the ambient temperature of the fluorescent tube 64 from being raised. In addition, the holes 94 formed at the top portion of the globe 90 are located adjacent to the upper tops of the reverse U-shaped tube portions 66 and 67 of the fluorescent tube 64. Therefore, heat discharge effect is enhanced at two upper tops of the tube 64 and these tops are locally cooled by the outside air entering through the holes 94, so that the fluorescent tube 64 is provided with most cooled portions. If the most cooled portions are present partially in the curved fluorescent tube 64, the vapor pressure of mercury in the tube 64 is determined by the temperature in most cooled portions thereof. Namely, even if areas in which temperature is higher than that in the most cooled portions are present in the fluorescent tube 64, most of excess mercury will be condensed in the most cooled portions of the tube 64 to thereby prevent the vapor pressure from being raised in the fluorescent tube 64. Therefore, the luminous efficacy of the fluorescent tube 64 can be improved as compared with in the conventional one.

The following table shows a comparison between ratios of luminous flux reduction attained by the fluorescent lamp according to the present invention and by conventional ones.

TABLE

| | Ratio of luminous flux reduction (%) |
|---|---|
| Conventional lamp A | about 43 |
| Conventional lamp B | 32 |
| Lamp according to the invention | 12 |
| Lamp according to the invention without ventilating slits (60) | 15 |

The ratio of luminous flux reduction in the table means a factor of showing how all luminous flux of each of actual fluorescent lamps is reduced as compared with all luminous flux attained by an ideal fluorescent lamp wherein the fluorescent tube is housed in the lamp housing while the ballast is experimentally located outside the housing so as to leave the fluorescent tube uninfluenced by the ballast. It is apparent that the lightening efficiency of lamp becomes better as the ratio of luminous flux reduction becomes smaller. "Lamp according to the invention" represents the embodiment of fluorescent lamp as described throughout the specification and a fluorescent tube of 20 W was employed. "Conventional lamp A" represents a fluorescent lamp wherein both of fluorescent tube of 20 W and ballast are housed in a same space inside the housing. "Conventional lamp B" denotes a fluorescent lamp wherein the fluorescent tube of 20 W and the ballast and housed in different spaces inside the envelope. Four kinds of lamps, including a lamp of this invention with no ventilating slits 60, were turned ON with their screw base sides vertically down, and all luminous flux in each case was measured when the light outputs from the above lamps became stable under the same conditions. As apparent from the table, it has been found that the fluorescent lamp according to the present invention, even when the ventilating slits 60 are not provided, has an extremely lower ratio of all luminous flux reduction as compared with conventional ones and that the fluorescent lamp according to the present invention allows the fluorescent tube to be left almost uninfluenced by heat radiated from the ballast.

Although the present invention has been shown and described with respect to a particular embodiment, various changes and modifications which are obvious to a person skilled in the art are deemed to lie within the spirit, scope and contemplation of the present invention. The curved fluorescent tube is not limited to the one employed in the above-described embodiment, but may be simply U-shaped or variously modified. The arrangement of housing the ballast is not limited to the one in the embodiment but may be variously modified within the scope of the present invention.

What we claim is:

1. A fluorescent lamp device, comprising:

a ballast;

a fluorescent tube which is electrically connected to said ballast and curved at least at one portion thereof to have a predetermined configuration;

a connector which is electrically connected to said ballast and detachably connected to an external socket to receive electric power;

envelope means defining an inner space for housing said ballast and said fluorescent tube therein to hold said connector in such a manner as to project externally from the envelope means and allow light emitted from said fluorescent tube to be transmitted therethrough;

insulation means, provided in said envelope means, for establishing first and second spaces in said inner space of said envelope means, said first and second spaces having said ballast and said fluorescent tube respectively positioned therein, and for thermally insulating said ballast and said fluorescent tube relative to one another;

first heat discharge means for causing said fluorescent tube to contact at least partially and directly with ambient air outside said envelope means independently of said ballast and for promoting heat exchange between said fluorescent tube and the ambient air; and second heat discharge means for causing said ballast to be contacted at least partially and directly with the outside air independently of said fluorescent tube so as to promote heat exchange between said ballast and the outside air; wherein said envelope means includes a bowl-shaped member which stably houses said ballast therein and holds said connector so as to project outside therefrom, said bowl-shaped member having an open end, and said insulation means includes a plate member made of thermally insulating material and attached to the open end of said bowl-shaped member; wherein said bowl-shaped member has a side provided with at least one hole at a predetermined area thereof so as to directly communicate the inner space of said bowl-shaped member, in which said ballast is housed, with the outside air, said second heat discharge means being constituted by said at least one hole; wherein said envelope means further includes a transparent material globe member attached to the open end of said bowl-shaped member so as to enclose said fluorescent tube and transmit light emitted from the fluorescent tube to the outside; wherein said first heat discharge means includes air-duct means, integral to said bowl-shaped member, for thermally insulating said ballast from the outside air and for communicating the outside air with the space which is formed by said globe member and plate members and in which said fluorescent tube is housed; and wherein said air-duct means includes grooves arranged substantially opposite to each other at said bowl-shaped member and having open ends on that side at which said bowl-shaped member is opened, and said plate member has recesses each having a shape corresponding to the open end of said grooves and into which the open ends of said grooves are closely fitted.

2. A fluorescent lamp device according to claim 1, wherein said globe member has a top portion at which at least one hole is provided adjacent to said portion of said fluorescent tube.

3. A fluorescent lamp device according to claim 1, wherein said connector includes a screw base member detachably fitted into an external screw socket for an incandescent lamp.

4. A fluorescent lamp device according to claim 1, wherein said bowl-shaped member has its said side provided with a plurality of elongated holes extending parallel to one another in the circumferential direction of said bowl-shaped member.

5. A fluorescent lamp device according to claim 2, wherein said fluorescent tube includes two tube portions curved, and said globe member is provided at the top portion with a plurality of holes corresponding to said curved tube portions.

6. A fluorescent lamp device, comprising:

a ballast;

a fluorescent tube which is electrically connected to said ballast and curved at least at one portion thereof to have a predetermined configuration;

a connector which is electrically connected to said ballast and detachably connected to an external socket to receive electric power;

envelope means defining an inner space for housing said ballast and said fluorescent tube therein to hold said connector in such a manner as to project externally from the envelope means and to allow light emitted from said fluoresent tube to be transmitted therethrough;

insulation means, provided in said envelope means, for establishing first and second spaces in said inner space of said envelope means, said first and second spaces having said ballast and said fluorescent tube respectively positioned therein, and for thermally insulating said ballast and said fluorescent tube relative to one another;

first heat discharge means for causing said fluorescent tube to contact at least partially and directly with ambient air outside said envelope means independently of said ballast and for promoting heat exchange between said fluorescent tube and the ambient air; and second heat discharge means for causing said ballast to be contacted at least partially and directly with the outside air independently of said fluorescent tube so as to promote heat exchange between said ballast and the outside air; wherein said envelope means includes a bowl-shaped member which stably houses said ballast therein and holds said connector so as to project outside therefrom, said bowl-shaped member having an open end, and said insulation means includes a plate member made of thermally insulating material and attached to the open end of said bowl-shaped member; wherein said bowl-shaped member has a side provided with at least one hole at a predetermined area thereof so as to directly communicate the inner space of said bowl-shaped member, in which said ballast is housed, with the outside air, said second heat discharge means being constituted by said at least one hole;

said fluorescent lamp device further comprising support means for stably attaching said fluorescent tube to said plate member which is attached to said bowl-shaped member, said support means supporting grooves arranged adjacent to portions of said fluorescent tube housed in a globe member.

7. A fluorescent lamp device according to claim 6, wherein the portions of said fluorescent tube have end portions at which electrodes are arranged.

* * * * *